US006417825B1

(12) United States Patent
Stewart et al.

(10) Patent No.: US 6,417,825 B1
(45) Date of Patent: Jul. 9, 2002

(54) ANALOG ACTIVE MATRIX EMISSIVE DISPLAY

(75) Inventors: Roger G. Stewart, Neshanic Station; Alfred C. Ipri, Princeton, both of NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/200,513

(22) Filed: Nov. 25, 1998

Related U.S. Application Data

(60) Provisional application No. 60/102,236, filed on Sep. 29, 1998.

(51) Int. Cl.[7] ..... G09G 3/30

(52) U.S. Cl. ..... 345/77; 345/76; 345/78; 345/80

(58) Field of Search ..... 345/76, 78, 80, 345/205, 206, 90, 92, 147, 77, 148, 149

(56) References Cited

U.S. PATENT DOCUMENTS

| | | | | | |
|---|---|---|---|---|---|
| 3,601,532 | A | * | 8/1971 | Bitzer et al. | 348/797 |
| 4,087,792 | A | | 5/1978 | Asars | 345/77 |
| 4,222,106 | A | * | 9/1980 | Hess et al. | 364/521 |
| 4,554,539 | A | * | 11/1985 | Wald et al. | 345/76 |
| 4,723,171 | A | * | 2/1988 | Kuijk et al. | 358/230 |
| 4,841,294 | A | * | 6/1989 | Clerc | 345/147 |
| 5,039,978 | A | | 8/1991 | Kronberg | 340/815.43 |
| 5,302,966 | A | | 4/1994 | Stewart | 345/147 |
| 5,587,329 | A | * | 12/1996 | Hseuh et al. | 438/30 |
| 5,652,600 | A | * | 7/1997 | Khormaei et al. | 345/76 |
| 5,764,211 | A | | 6/1998 | Tagawa et al. | 345/94 |
| 5,781,167 | A | | 7/1998 | Rebeschi et al. | 345/76 |
| 5,812,104 | A | * | 9/1998 | Kapoor et al. | 345/76 |
| 5,926,160 | A | * | 7/1999 | Furuya | 345/98 |
| 5,956,004 | A | * | 9/1999 | Hush et al. | 345/74 |
| 6,008,793 | A | * | 12/1999 | Shigeta | 345/149 |

* cited by examiner

*Primary Examiner*—Richard Hjerpe
*Assistant Examiner*—Kevin M. Nguyen
(74) *Attorney, Agent, or Firm*—William J. Burke

(57) ABSTRACT

An emissive display device such as an active matrix electroluminescent display (AMEL display) has an improved method of operation. The AMEL display produces gray scale operation comprising an array of pixels, each pixel including a first transistor having its gate connected to a select line, its source connected to a data line, and its drain connected to the gate of a second transistor. The second transistor has its source adapted to receive a ramped voltage level, and its drain connected to a first electrode of an electroluminescent cell. The electroluminescent cell has a second electrode connected to an alternating current high voltage power source, wherein the electroluminescent cell is illuminated, when the ramp voltage level is less than a voltage level on the gate of the second transistor. The ramp voltage level is increased linearly during a frame duration, and the alternating current high voltage power source is on continuously during the same frame duration. The alternating current high voltage power source may also be varied in amplitude from a minimum peak-to-peak value to a maximum peak-to-peak value during the frame duration.

16 Claims, 10 Drawing Sheets

ANALOG ACTIVE MATRIX EMISSIVE DISPLAY

CROSS REFERENCE TO RELATED APPLICATIONS

This application claims benefits of Provisional No. 60/102,236 filed Sep. 29, 1998, the contents of which are encorporated herein by reference.

GOVERNMENT RIGHTS IN THIS INVENTION

This invention was made with U.S. government support under contract number DARPA contrat DAAB07-96-D-H754. The U.S. government has certain rights in this invention.

TECHNICAL FIELD

The present invention relates, in general, to active matrix emissive displays and, more particularly, to an emissive display which uses an analog driving technique to display grayscale.

BACKGROUND OF THE INVENTION

Thin film active matrix electroluminescent (EL) (AMEL) displays are well known in the art and are used as flat panel displays in a variety of applications. A typical display includes a plurality of picture elements (pixels) arranged in rows and columns. Each pixel contains an EL cell having an EL phosphor active layer between a pair of insulators and a pair of electrodes. Additionally, each pixel contains switching circuitry that controls illumination of the cell. The electroluminescent display is one example of an emissive display. Other examples include field emissive displays and plasma displays.

One example of a prior art AMEL display is disclosed in U.S. Pat. No. 5,587,329, issued Dec. 24, 1996 to Hseuh et al. The disclosed AMEL display is shown in FIG. 1 which depicts a schematic diagram of an AMEL display 100. The AMEL display contains an arrangement of rows and columns of AMEL display pixels. FIG. 1 depicts one of these AMEL display pixels 102. In accordance with that disclosure, the pixel 102 contains an electric field shield 104 between a switching circuit 106 and an EL cell 108.

As for the specific structure of the AMEL display pixel 102, the switching circuit 106 contains a pair of transistors 110 and 112 that are switchable using a select line 114 and a data line 116. To form circuit 106, transistor 110, typically a low voltage metal oxide semiconductor (MOS) transistor, has its gate connected to the select line 114, its source connected to the data line 116, and its drain connected to the gate of the second transistor 112 and, through a first capacitor 118, to the electric field shield 104. The electric field shield is connected to ground. The first capacitor is actually manifested as the capacitance between the shield 104 and the gate electrode of transistor 112. To complete the switching circuit, transistor 112, typically a high voltage MOS transistor, has its source connected to the data line 116 and its drain connected to one electrode of the EL cell 108. A high voltage bus 122 connects the second electrode of the EL cell to a high voltage (e.g., 250 volts) alternating current (AC) source 120.

The transistors used to form the switching circuit 106 may be of any one of a number of designs. Typically, the first transistor is a low breakdown voltage (less than 10 volts) MOS transistor. The second transistor is typically a double diffused MOS (DMOS) device having a high breakdown voltage (greater than 150 volts). The transistors can be either n- or p-channel devices or a combination thereof, e.g., two NMOS transistors, two PMOS transistors or a combination of NMOS and PMOS transistors.

In operation, images are displayed on the AMEL display as a sequence of frames, in either an interlace or progressive scan mode. During an individual scan, the frame time is subdivided into a separate LOAD period and an ILLUMINATE period. During the LOAD period, an analog-to-digital converter 124 and a low impedance buffer 126 produce data for storage in the switching circuitry. The data is loaded from the data line 116 through transistor 110 and stored in capacitor 118. Specifically, the data lines are sequentially activated one at a time for the entire display. During activation of a particular data line, a select line is activated (strobed). Any transistor 110, located at the junction of activated data and select lines, is turned ON and, as such, the voltage on the data line charges the gate of transistor 112. This charge is primarily stored in capacitor 118.

As the charge accumulates on the gate of transistor 112, the transistor begins conduction, i.e., is turned ON. At the completion of the LOAD period, the high voltage transistor in each pixel that is intended to be illuminated is turned ON. As such, during the ILLUMINATE period, the high voltage AC source that is connected to all the pixels in the display through bus 122 is activated and simultaneously applies the AC voltage to all the pixels. However, current flows from the AC source through the EL cell and the transistor 112 to the data line 116 in only those pixels having an activated transistor 112. Consequently, during the ILLUMINATE period of each frame, the active pixels produce electroluminescent light from their associated EL cells.

The operation of the AMEL display is also disclosed in U.S. Pat. No. 5,302,966 issued Apr. 12, 1994 and is incorporated herein by reference. As disclosed therein, during operation, the frame time is divided into separate LOAD periods and ILLUMINATE periods. During LOAD periods, data are loaded, one line at a time, from the data line through transistor 110 in order to control the conduction of transistor 112.

During a particular data line ON, a select line is strobed. On those select lines having a select line voltage, transistor 110 turns on allowing charge from data line 116 to accumulate on the gate of transistor 112 thereby turning transistor 112 on. At the completion of a LOAD period the second transistors of all activated pixels are on. During the ILLUMINATE period the high voltage AC source 120 connected to all pixels, is turned on. Current flows from the source through the EL cell and the transistor 112 to the data line at each activated pixel, producing an electroluminescent light output from the activated pixel's EL cell.

The buffer amplifier 126 holds the voltage on the data line 116 at its nominal value during the ILLUMINATE period. The data which is capacitively stored on the gate of transistor 112 operates through transistor 112 to control whether the pixel will be white, black, or gray. If, for example, the gate of transistor 112 stores a 5 V level (select @ −5V and data @ 0V), then transistor 112 will conduct through both the positive and negative transitions of the input voltage at the bus 122, which effectively grounds Node A. This allows all of the displacement current to flow from the input electrode 122 through the EL cell 108, which in turn lights up the pixel. If the gate of transistor 112 stores a −5V level (select @ −5V and data @ −5V), then transistor 112 will remain off through all positive transitions of the input voltage at the input bus 122. Transistor 112 thus behaves like a diode, which charges the capacitance associated with the EL cell, and quickly suppresses the flow of alternating current through the EL phosphor thereby turning the pixel off.

Gray scale control of each pixel is achieved by varying the voltage on the data line during each of the individual (typically 128) ILLUMINATE periods of each field of a frame. The voltage variation may be a linear ramp of the voltage, a step function in voltage, with each step corresponding to a level of gray. If, for example, the gate of transistor 112 stores a −1.5V gray-scale level (select @ −5V and $V_{th}$ =1V) and the data line is ramped linearly from 5V to −5V during the field, then transistor 112 will conduct for approximately 32 of the 128 ILLUMINATE sub-cycles resulting in a time-averaged gray-scale brightness of 25 %.

Note that the AMEL display pixel always operates digitally even when displaying gray-scale information. All transistors are either fully-on or fully-off and dissipate no power in either state. When a pixel is off, it simply acts as if it is disconnected from the resonant power source and therefore does not dissipate or waste any power.

Another method for providing greyscale control of the AMEL display comprises executing, during a frame time, a number of LOAD/ILLUMINATE periods (subframes). During the LOAD period of the first of these subframes, data corresponding to the least significant bit (LSB) is loaded into the circuitry of each pixel. During the ILLUMINATE period of each subframe, the high voltage source emits a number of pulses $N_{LSB}$. This procedure is repeated for each subframe up to the one corresponding to the most significant bit, with a greater number of pulses emitted for each more significant bit. For example, for a four bit greyscale, the high voltage source emits one pulse for the LSB, two pulses for the next most significant bit, four pulses for the next most significant bit and so on, thereby weighting the excitation of the EL cell and its emission corresponding to the significance of the particular bit. This procedure is equivalent to dividing a frame into a number of subframes, each of which is then operated in a similar way to procedure outlined above for no gray scale.

The second transistor, thus, operates as a means for controlling the current through an electroluminescent cell. The gate is either on or off during the ILLUMINATE periods but greyscale information is provided by limiting the total energy supplied to the pixel. This is done by varying the length of time this second transistor is on during the ILLUMINATE period or by varying the number of ILLUMINATE pulses emitted during an ILLUMINATE period.

The digitally driven AMEL display, as disclosed by the prior art, is limited in maximum brightness to about 250 nits, because of the time domain greyscale approach of the digital driver. In addition, the total display and driver system power dissipation of the digital AMEL display at 250 nits is 3.2 W. The digital driver also limits the number of gray levels to about 4 bits due to the time domain approach, as well as the properties of the EL material when driven in a non-continuous mode.

The problems with the prior art pixel operations are three-fold. First, the power dissipation is high because an external frame store memory, large number of data lines, and a high operating frequency are needed for the temporal greyscale. Second, only a limited number of gray shades are obtainable, due to the frequency limitations of the temporal greyscale technique. Third, a low maximum brightness is achievable due to the need for a separate non-illuminating load and illuminate cycle.

A need still exists, therefore, to improve the AMEL display by lowering its power dissipation, increasing the number of grey levels to more than 4 bits, and increasing its maximum brightness by eliminating the need for a separate load and illuminate cycle.

SUMMARY OF THE INVENTION

To meet this and other needs, and in view of its purposes, the present invention provides an emissive display having an array of pixels with each pixel including a circuit for controlling illumination of the pixel. The circuit includes a first line for loading analog data into the circuit; a second line for applying a threshold reference level to the circuit; and a comparator for comparing the analog data to the threshold reference level. The comparator has an enable output that is activated when the analog data level is above the threshold reference level. A means is provided for coupling the enable output to one of the pixels, wherein the pixel is illuminated when the enable output is activated. The emissive display is loaded with the analog data at anytime during a frame duration.

In another embodiment, the invention includes an improved method of operating the AMEL display to produce gray scale operation for an array of pixels. Each pixel includes a first transistor having its gate connected to a select line, its source connected to a data line, and its drain connected to the gate of a second transistor. The second transistor has its source adapted to receive a ramped voltage level, and its drain connected to a first electrode of an electroluminescent cell. The electroluminescent cell has a second electrode connected to an alternating current, high voltage power source, wherein the electroluminescent cell is illuminated, when the ramp voltage level is less than a voltage level on the gate of the second transistor. The ramp voltage level is increased linearly during a frame duration, and the alternating current high voltage power source is on continuously during the same frame duration. The alternating current high voltage power source may also be varied in amplitude from a minimum peak-to-peak value to a maximum peak-to-peak value during the frame duration.

In a third embodiment, the invention includes a method for hiding visual artifacts and extending gray scale range in an array of pixels including providing temporal dithering of a pixel in the array during an intra-frame period. Temporal dithering of the pixel is also provided during an inter-frame period. Spatial dithering of the pixel is also provided. This method of interleaved use of spatial dithering, inter-frame temporal dithering, and intra-frame temporal dithering is more effective in hiding visual artifacts than any of these are when applied separately.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

In order to overcome the high power dissipation and the minimum number of gray levels, a new pixel structure and method for operating the same has been achieved, and is disclosed herein. The new pixel operates with analog input data, eliminates the need for external frame store circuitry, and operates at a much lower frequency. The new pixel may also be loaded with data at any time during the frame time (period), eliminating the need for a separate non-illuminating load cycle.

Figure 1:
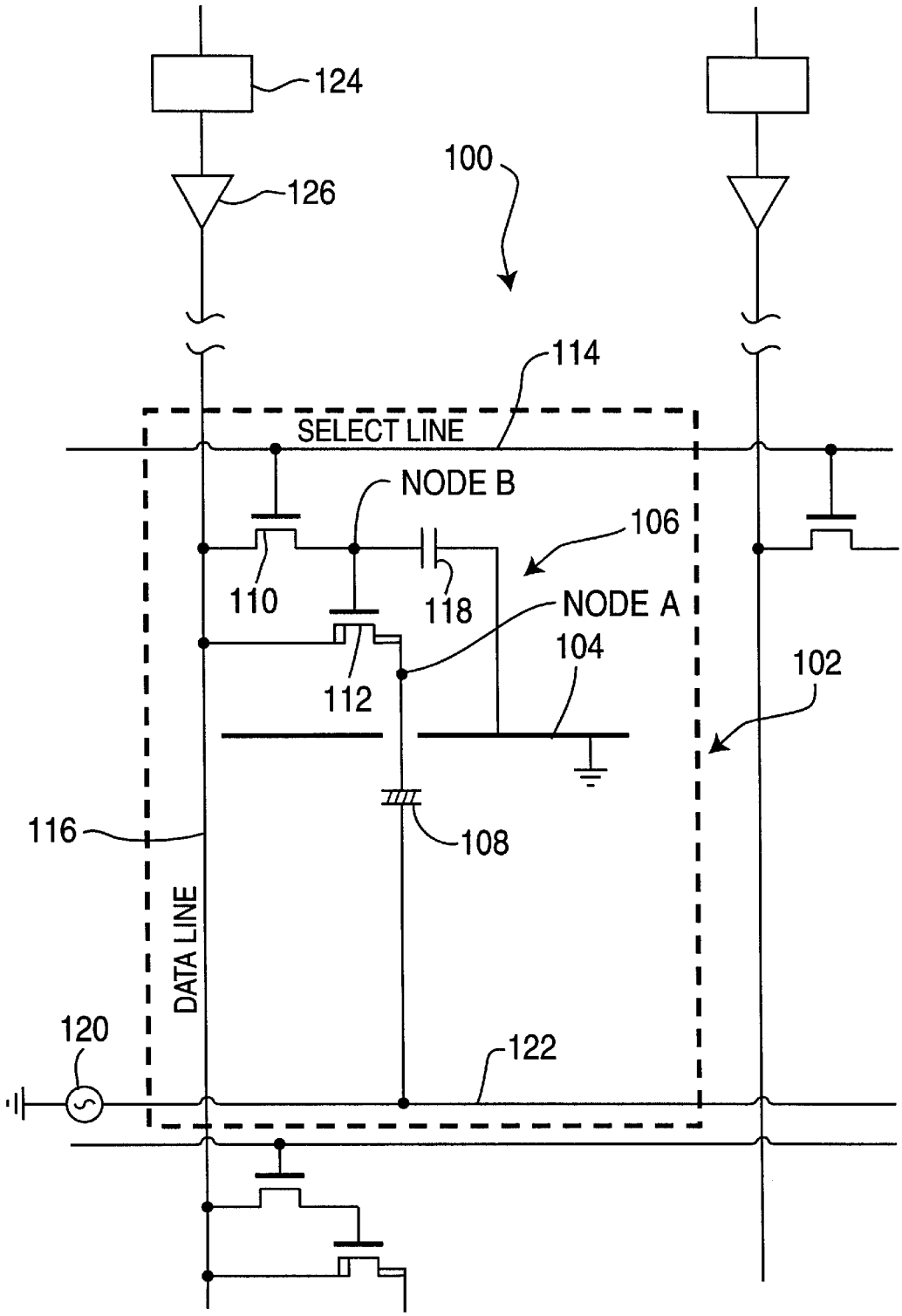
FIG. 1 (Prior Art) depicts a schematic diagram of an AMEL display pixel driven in a conventional manner.
Figure 2:
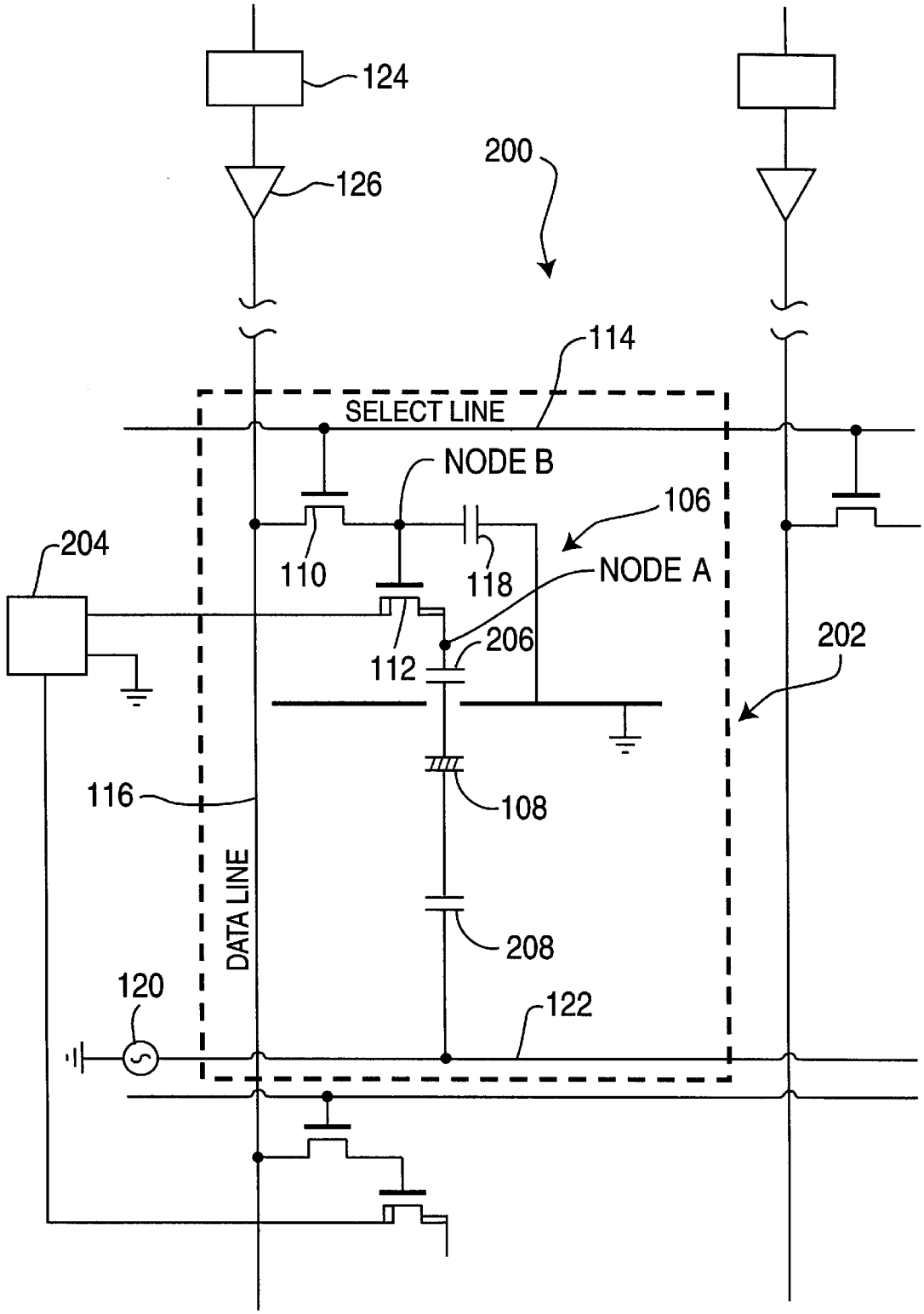
FIG. 2 depicts a schematic diagram of an AMEL display pixel driven by an analog driver in accordance with one embodiment of the present invention.
Figures 3A, 3B, 3C, 3D:
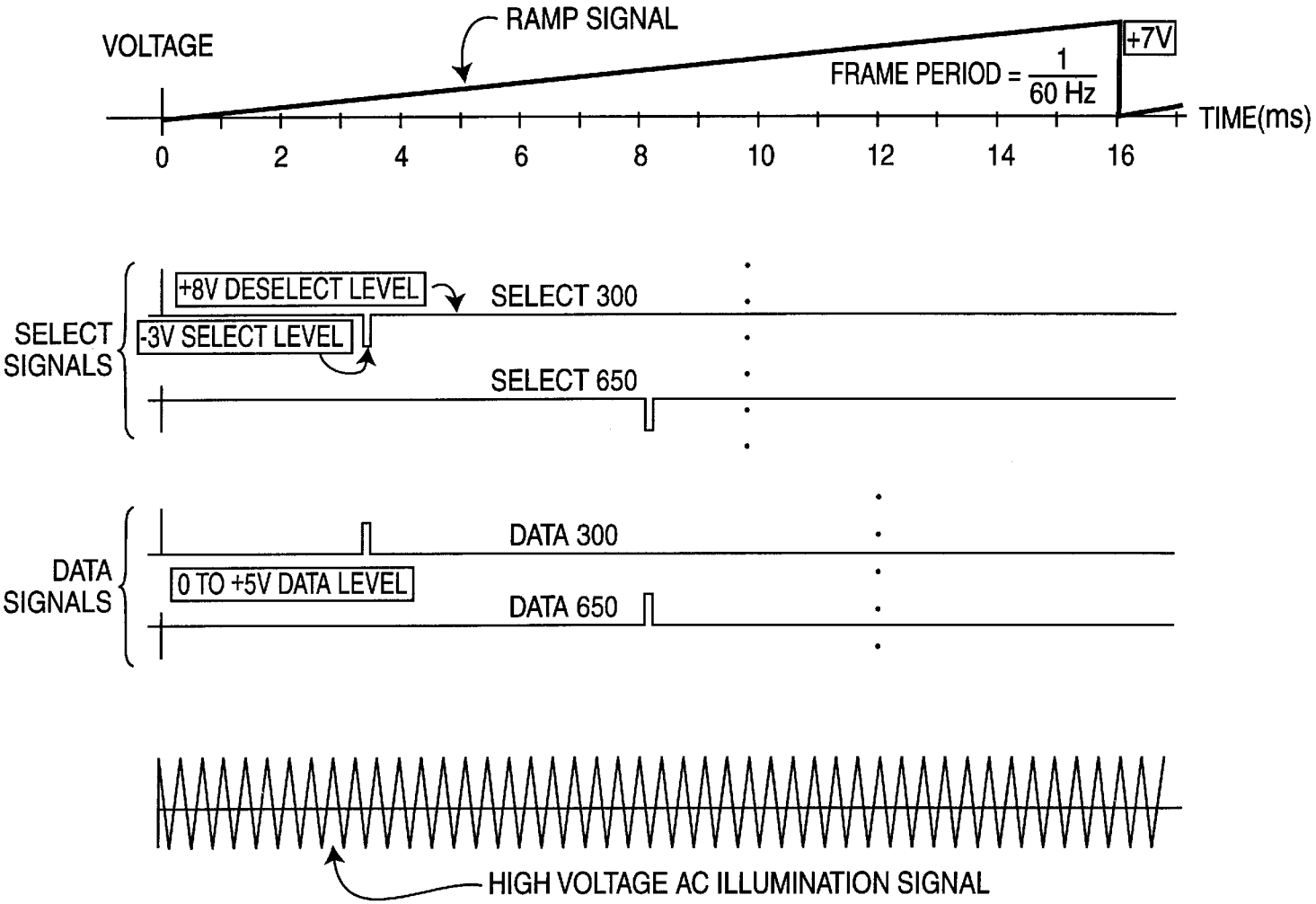
FIGS. 3*a* through 3*d* are diagrams of voltage versus time, which illustrate electrical signals that may be applied to the AMEL display pixel in accordance with one embodiment of the present invention.

To facilitate understanding, identical reference numerals have been used, where possible, to designate identical elements that are common to the figures. FIG. 2 shows an analog AMEL display 200 which includes a ramp signal for greyscale generation. For simplicity, FIG. 2 depicts only one of these AMEL display pixels 202. In accordance with a preferred embodiment of the present invention, pixel 202 contains elements previously described with reference to FIG. 1. Also shown in FIG. 2 is a ramp generator 204 connected to transistor 112. A pair of capacitors 206 and 208 have been added, as shown, connected in series with EL 108. The EL cell is shown in series with two capacitors, which are blocking capacitors formed as part of the structure of the EL cell.

Analog data levels are loaded by way of data line 116 into each individual pixel during the 60 Hz frame time using, for example, sample-and-hold data scanner circuitry (not shown). This circuitry permits the data to be transmitted to the display at lower voltages than needed by the display. The data is loaded into the array, one row at a time, on a continual basis during illumination. The illumination is continuous in order to be able to achieve high brightness. Furthermore, this loading technique eliminates the need for a frame store memory in the external system electronics.

Ramp generator 204 generates a ramp signal that increases from a minimum voltage (e.g. ground) at the beginning of the 60 Hz frame time and reaches a maximum voltage at the end of the frame. The ramp signal is applied to the pixel at the source electrode of transistor 112 and is compared to the pixel data voltage stored on the gate electrode of transistor 112. During the frame time when the ramp voltage is less than the data voltage, the pixel is in an "on" condition and emits light. During the portion of the frame time when the ramp voltage is greater than the pixel data voltage, however, the pixel is "off." Gray shades result because the pixel is "on" for only a portion of the frame time, and the human eye time-averages the brightness of the pixel to achieve the gray level.

When the select line 114 is low, the analog data level is loaded into the pixel from the data line 116 through transistor 110 and is stored in capacitor 118. As long as the stored voltage level across capacitor 118 is greater than the ramp voltage generated by ramp generator 204, transistor 112 remains "on" and conducing. While transistor 112 is in the conducting state, current from AC source 120 flows through capacitors 206 and 208, as well as EL 108 and the pixel emits light. When the ramp voltage equals the stored voltage level (minus the gate-to-source threshold voltage of transistor 112), transistor 112 turns off and light is no longer emitted from the pixel.

FIGS. 3*a*–3*d* illustrate the electrical signals which may be applied to the pixel during operation. During the 16.6 ms frame time, the ramp signal (FIG. 3*a*) is increased from approximately 0.0V to 7.0V. Analog data levels (FIG. 3*c*) are continuously loaded into the various pixels in the array, for example, pixel 300 and pixel 650. The data levels are loaded by way of transistor 110 when the select signals (FIG. 3*b*) are active at the −3V select level. When the −3V select signal on select line 114 and a more positive data signal on data line 116 are present, transistor 110 (in this example, a PFET transistor) is turned "on" and capacitor 118 is charged. The high voltage AC illumination signal (FIG. 3*d*) is run continuously by AC source 120. In the example shown, the AC illumination signal is run at 2.5 kHz. Thus, one AC pulse (cycle) is 0.4 msec in duration. When both the AC pulse is present on line 122, and the ramp signal at the source of transistor 112 (in this example, a NFET transistor) is less then the voltage across capacitor 118 by the threshold voltage of transistor 112, transistor 112 is turned on and conducting, consequently, EL 108 is illuminated. It will be appreciated that the AC illumination signal may be run at a higher frequency (for example, 10 kHz), so that more AC pulses are available per unit of time.

It will be appreciated that when the display is driven continuously with an AC high voltage frequency of 10 kHz and a frame time of 60 Hz, the number of AC illumination pulses per frame is 167 and, therefore, the maximum number of non-inhibited gray shade bits is approximately 7. It will also be appreciated that to more closely match the brightness nonlinearity of the eye, the ramp may be made non-linear.

If the display is driven continuously with an AC high voltage frequency of 2.5 kHz and a frame time of 60 Hz, the number of illumination pulses per frame is approximately 42 and, therefore, the maximum number of non-inhibited gray shade bits is approximately 5 (dynamic range ~30:1). More apparent gray levels may not be achieved using this excitation frequency, because the smallest bit must contain at least one AC pulse. In order to achieve more gray levels, it may be desirable to generate lower order bits containing less than one AC pulse. This may be achieved by "inhibiting" the first AC pulse on a periodic basis, for example every other frame.

Figures 4A, 4B, 4C, 4D, 4E:
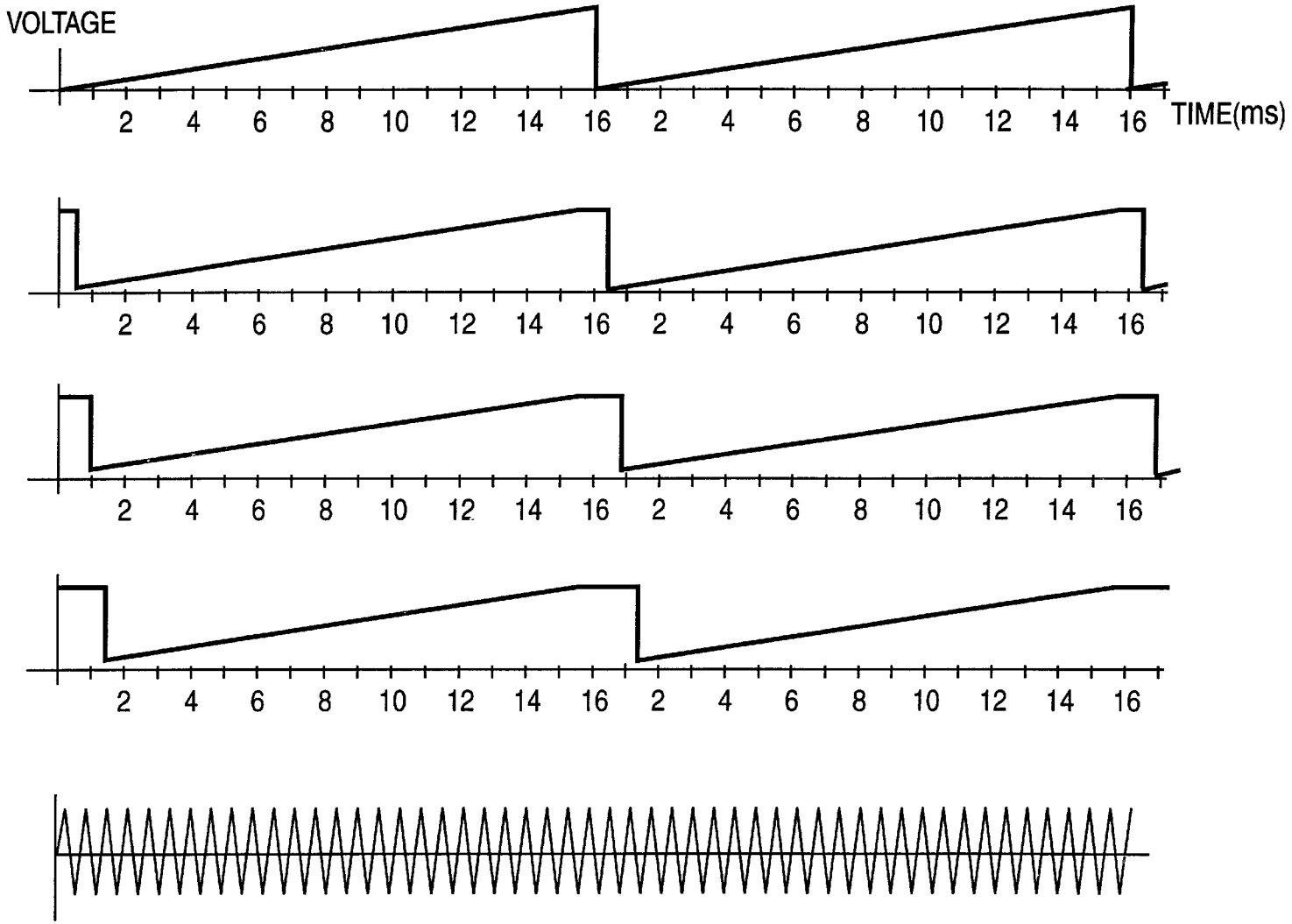
FIGS. 4*a* through 4*e* are diagrams of voltage versus time which illustrate electrical signals that may be applied to the AMEL display pixel in accordance with another embodiment of the present invention.

FIGS. 4*a*–4*e* show how the ramp signal may be modified to inhibit the AC pulses. FIGS. 4*a* and 4*e* are the same signals discussed above, while FIGS. 4*b*, 4*c* and 4*d* are modifications of FIG. 4*a*. These three figures show the ramp signal having a peak voltage (the off voltage) extended in time, such that one-to-three AC pulses of FIG. 4*e* are inhibited from generating light. If, for example, a pixel is loaded with an analog voltage which calls for only the first AC pulse to generate light, then applying the inhibit pulse shown in FIG. 4*b* causes the pixel to emit no light. No light is emitted, because transistor 112 is "off" when the ramp voltage level is higher (by the threshold voltage) than the gate voltage of transistor 112. By extending the width of the inhibit pulse, as shown in FIGS. 4*c* and 4*d* for example, the pixel will not emit light for a greater portion of the frame period.

A second variation on temporal dithering may be realized by having more than one inhibit bit present within a single frame period. A third variation on temporal dithering may be realized by placing the inhibit bit at various points along the ramp. This may be seen by comparing FIGS. 9*a* and 9*b* with FIGS. 10*a* and 10*b*, which illustrate the inhibit bit technique for a system having only four AC excitation pulses per frame period. It will be appreciated that four AC excitation pulses are shown in order to better demonstrate the technique with actual plots of the relative illumination of a pixel as it is subjected to an inhibit bit. In a typical system there are, for example, 167 AC excitation pulses (corresponding to a 10 kHz signal).

Figure 9A:
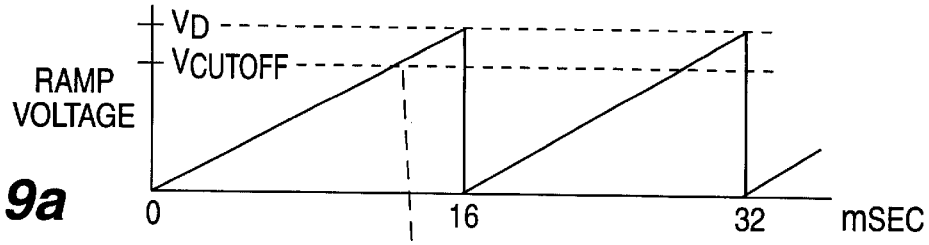
FIG. 9*a* is a diagram of a linear voltage ramp which may be applied to the AMEL display pixel in accordance with an embodiment of the present invention.
Figure 9B:
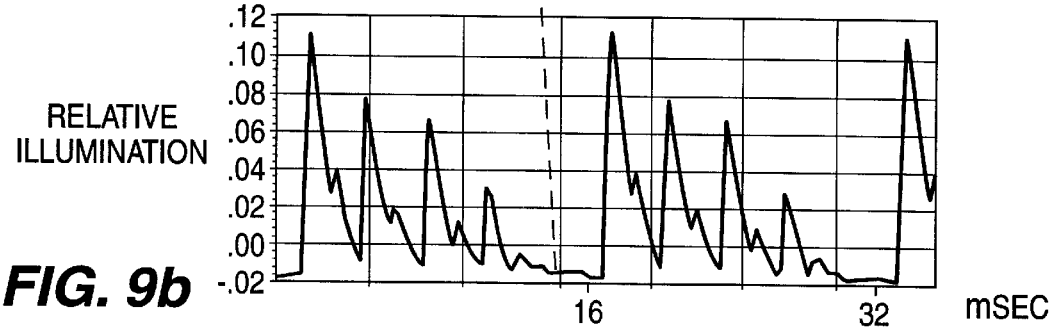
FIG. 9*b* is a diagram of the relative illumination of the pixel when subjected to the voltage ramp of FIG. 9*a;*

FIG. 9*a* shows a 60 Hz ramp (16 msec frame period) without an inhibit bit. FIG. 9*b* shows the relative illumination of a pixel during the corresponding 16 msec period. As the ramp increases in voltage, the pixel is illuminated progressively less and less until the cut-off voltage (Vcut-off) is reached and no illumination is possible.

Figure 10A:
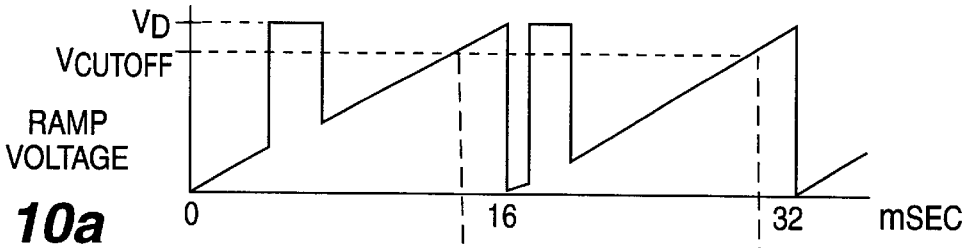
FIG. 10*a* is a diagram of a modified voltage ramp of FIG. 9*a;*
Figure 10B:
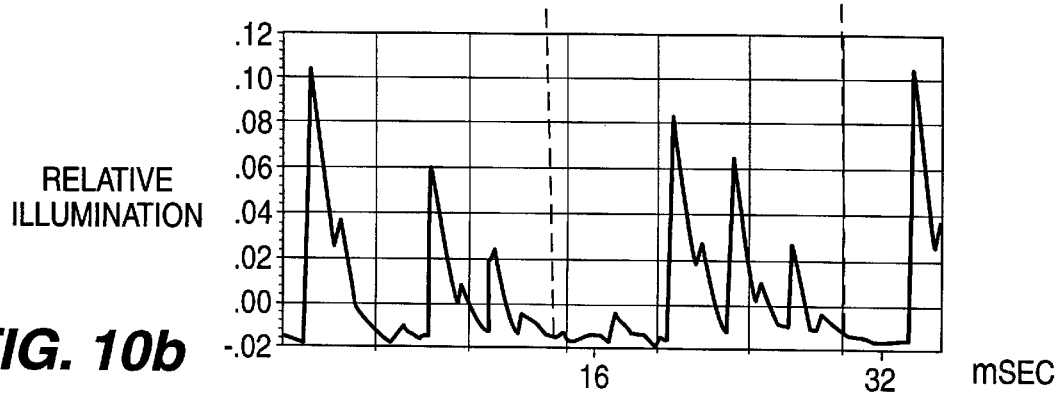
FIG. 10*b* is a diagram of the relative illumination of the pixel when subjected to the modified voltage ramp of FIG. 10*a*.

FIG. 10*a* shows a similar 16 msec ramp, except that an inhibit bit has been superimposed on the ramp during the time of the second AC excitation pulse. The resulting illumination of the pixel, as shown in FIG. 10*b*, is similar to that of FIG. 9*b*, except that the illumination due to the second inhibit bit is missing. This results in the pixel having a smaller relative intensity. Finally, the second frame shown in FIG. 10*a* has the inhibit bit superimposed on the ramp during the first AC excitation pulse, thereby preventing the first AC pulse from illuminating the pixel. It will be noted that the pixel in the second frame has a smaller relative intensity (integrated over the 16 msec frame period) as compared to the pixel in the first frame.

Figure 8:
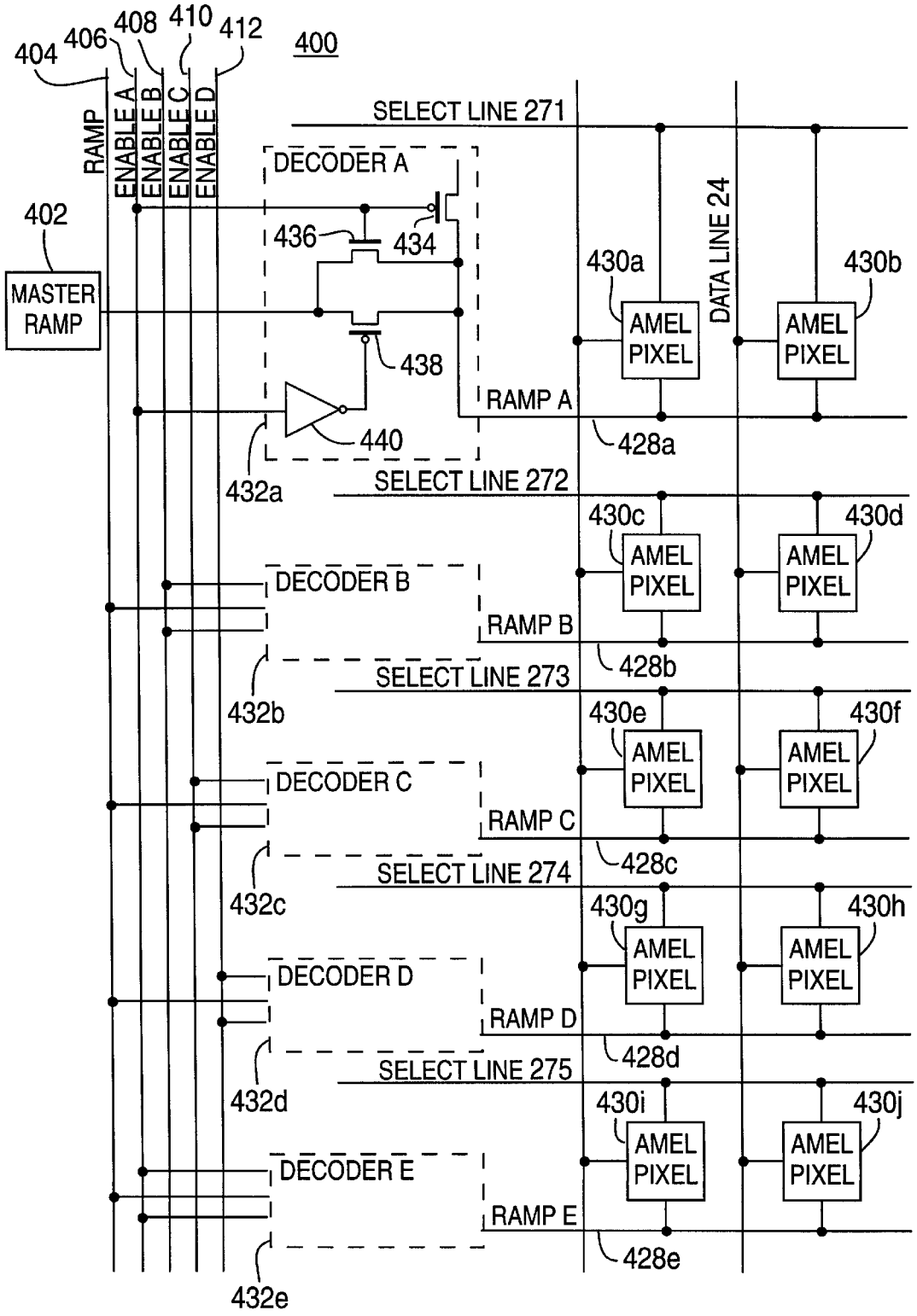
FIG. 8 depicts a schematic diagram of a balance bit inhibit circuit connected to various rows of AMEL display pixels in accordance with an embodiment of the present invention.

Having explained temporal dithering using a ramp with inhibit bits superimposed on the ramp, a combined technique of temporal dithering and spatial dithering will now be explained. Referring to FIG. 8, there is shown a balanced bit inhibit (BBI) decoding circuit 400. Four decoding circuits, namely decoder A (432*a*), decoder B (432*b*), decoder C (432*c*), decoder D (432*d*), and another decoder A (432*e*) are shown; each decoder provides a ramp signal with a superimposed inhibit bit to its respective row of AMEL pixels. Thus, decoder A provides ramp A signal (428*a*) to a row containing AMEL pixels 430*a*–*b*. Decoder B provides ramp B (428*b*) to a row containing AMEL pixels 430*c*–*d*. Decoder C provides ramp C (428*c*) to a row containing AMEL pixels 430*e*–*f*. Decoder D provides ramp D (428*d*) to a row containing AMEL pixels 430*g*–*h*. Finally, a second decoder A provides ramp A (428*e*) to a row containing AMEL pixels 430*i*–*j*. Still referring to FIG. 8, the aforementioned pixels are selected in a manner previously described by select lines 271–275, and contain data loaded from data lines 23 and 24.

Master ramp generator 402 provides the same ramp signal to all the decoders, as shown, by way of ramp line 404. Four enable lines, namely enable A (406), enable B (408), enable C (410) and enable D (412) respectively control decoders A, B, C and D. The operation of decoder A will now be described, which is similar to the operation of the other decoders. Decoder A comprises PFET transistor 434 having a drain coupled to a Vd supply (for example 7 volts), a gate coupled to the gate of NFET transistor 436 and a source coupled to PFET transistor 438. The gates of PFET 434 and NFET 436 are connected to enable A. The gate of PFET 438 is also connected to enable A by way of inverter 440.

Figures 11A, 11B, 11C:
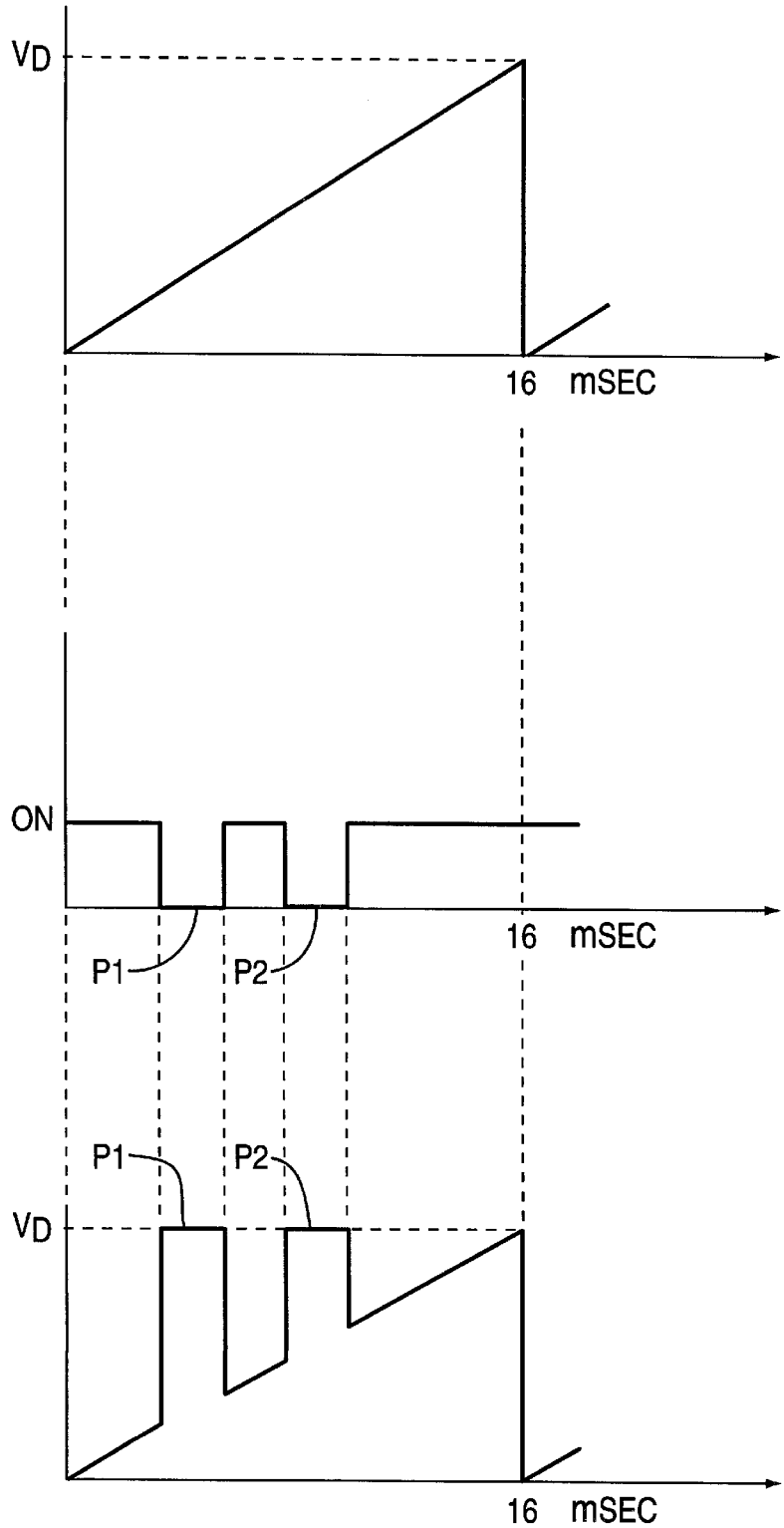
FIGS. 11*a* through 11*c* are diagrams of voltage verses time which illustrate signals that may be applied to the AMEL display pixel structure of FIG. 8.

In operation, master ramp generator 402 provides a linear ramp having a 16 msec frame period to decoder A, as shown in FIG. 11*a*. When enable A is turned on (high voltage), PFET 434 is off and NFET 436 and PFET 438 are both turned on, thereby allowing the linear ramp to propagate to AMEL pixels 430*a* and*b*. Thus, if enable A is turned on for the entire 16 msec frame period, a full level of brightness may be displayed by pixel 430*a* (assuming that data line 23 has called for 100% brightness). If, on the other hand, enable A is turned off during the intervals P1 and P2, as shown in FIG. 11*b*, PFET 434 is turned on and NFET 436 and PFET 438 are both turned off, thereby inhibiting the linear ramp during intervals P1 and P2, as shown in FIG. 11*c*. Stated differently, decoder A is effective in superimposing inhibit bits P1 and P2 on the linear ramp. As a result of the ramp being inhibited by inhibit bits P1 and P2, pixel 430*a* has a lesser illumination intensity as compared to 100% brightness.

It will now be appreciated that the brightness level of pixel 430*a* may be controlled by the various states of P1 and P2 inhibit pulses. For example, four states are possible within one frame, as shown in Table 1. The ramp may have (a) no inhibit pulse; (b) one inhibit pulse, P1; (c) one inhibit pulse, P2; and (d) both inhibit pulses, P1 and P2. It will further be appreciated that while FIG. 11*c* shows P1 and P2 activated at two distinct portions of the ramp, the inventors have discovered that it may be more effective to enable P2 immediately following P1. Stated differently, when the ramp contains both P1 and P2, the inhibit pulse is simply twice as long in duration as compared to either P1 only or P2 only.

TABLE 1

Four Subframe States

| | Legend |
|---|---|
| a) ramp without an inhibit pulse | 1 |
| b) ramp with a first inhibit pulse | P1 |
| c) ramp with a second inhibit pulse | P2 |
| d) complete inhibit (P1 and P2) | X |

Furthermore, by using the various combinations of the P1 and P2 inhibit pulses as a function of time (i.e. a different combination of P1 and P2 per intra-frame period or inter-frame periods), temporal dithering may be achieved. Moreover, by using the various combinations of the P1 and P2 inhibit pulses as a function of different rows of pixels (i.e. a different combination of P1 and P2 per row of pixels as controlled by ramp A, B, C, D, etc.), spatial dithering may be achieved. These combinations are illustrated in the following tables:

TABLE 2

No Balanced Bit Inhibit (BBI)
(100% Brightness)

temporal dithering →

| | ROW # | FRAME # 1 | 2 | 3 | 4 | 5 | 6 |
|---|---|---|---|---|---|---|---|
| spatial dithering ↓ | A | 1 | 1 | 1 | 1 | 1 | 1 |
| | B | 1 | 1 | 1 | 1 | 1 | 1 |
| | C | 1 | 1 | 1 | 1 | 1 | 1 |
| | D | 1 | 1 | 1 | 1 | 1 | 1 |
| | A | 1 | 1 | 1 | 1 | 1 | 1 |

"1" denotes no inhibit bits

TABLE 3

First Bit BBI
(50% Brightness)

temporal dithering →

| | ROW # | FRAME # 1 | 2 | 3 | 4 | 5 | 6 |
|---|---|---|---|---|---|---|---|
| spatial dithering ↓ | A | P1 | P2 | P1 | P2 | P1 | P2 |
| | B | P2 | P1 | P2 | P1 | P2 | P1 |
| | C | P1 | P2 | P1 | P2 | P1 | P2 |
| | D | P2 | P1 | P2 | P1 | P2 | P1 |
| | A | P1 | P2 | P1 | P2 | P1 | P2 |

"P1" denotes P1 inhibit bit present
"P2" denotes P2 inhibit bit present

TABLE 4

Second Bit BBI
(25% Brightness)

temporal →

| | ROW # | FRAME # 1 | 2 | 3 | 4 | 5 | 6 |
|---|---|---|---|---|---|---|---|
| spatial ↓ | A | P1 | X | P1 | X | P1 | X |
| | B | X | P2 | X | P2 | X | P2 |
| | C | P1 | X | P1 | X | P1 | X |
| | D | X | P2 | X | P2 | X | P2 |
| | A | P1 | X | P1 | X | P1 | X |

"P1" denotes P1 inhibit bit present
"P2" denotes P2 inhibit bit present
"X" denotes both P1 and P2 inhibit bits present

TABLE 5

Third Bit BBI
(12.5% Brightness)

temporal →

| | ROW # | FRAME # 1 | 2 | 3 | 4 | 5 | 6 |
|---|---|---|---|---|---|---|---|
| spatial ↓ | A | P1 | X | X | X | P1 | X |
| | B | X | X | P2 | X | X | X |
| | C | P2 | X | X | X | P2 | X |
| | D | X | X | P1 | X | X | X |
| | A | P1 | X | X | X | P1 | X |

"P1" denotes P1 inhibit bit present
"P2" denotes P2 inhibit bit present
"X" denotes both P1 and P2 inhibit bits present

TABLE 6

Fourth Bit BBI
(6.25% Brightness)

temporal →

| | ROW # | FRAME # 1 | 2 | 3 | 4 | 5 | 6 |
|---|---|---|---|---|---|---|---|
| spatial ↓ | A | P1 | X | X | X | P2 | X |
| | B | X | X | X | X | X | X |
| | C | X | X | P2 | X | X | X |
| | D | X | X | X | X | X | X |
| | A | P1 | X | X | X | P2 | X |

"P1" denotes P1 inhibit bit present
"P2" denotes P2 inhibit bit present
"X" denotes both P1 and P2 inhibit bits present With the bit inhibit combinations shown in Tables 2–6, it is possible to reduce brightness from 100% down to 6.25%. Even further reductions in brightness are possible, since the combined, interleaved use of spatial dithering, inter-frame temporal dithering, and intra-frame temporal dithering are much more effective in hiding visual quantization artifacts than any of these techniques are when applied separately.

It will also be appreciated that the ramp lines through the array of pixels may be segmented either along the data lines or along the select lines. FIG. 8 shows the ramp lines segmented along the select lines.

Figure 5A:
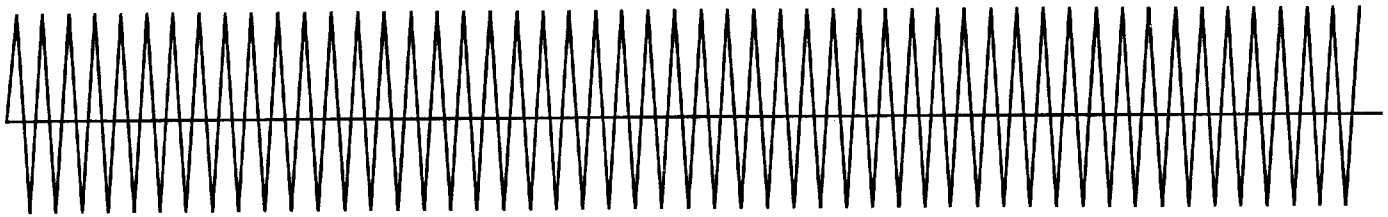
FIGS. 5*a* and 5*b* are diagrams of voltage versus time which illustrate electrical signals that may be applied to the AMEL display pixel in accordance with yet another embodiment of the present invention.
Figure 5B:
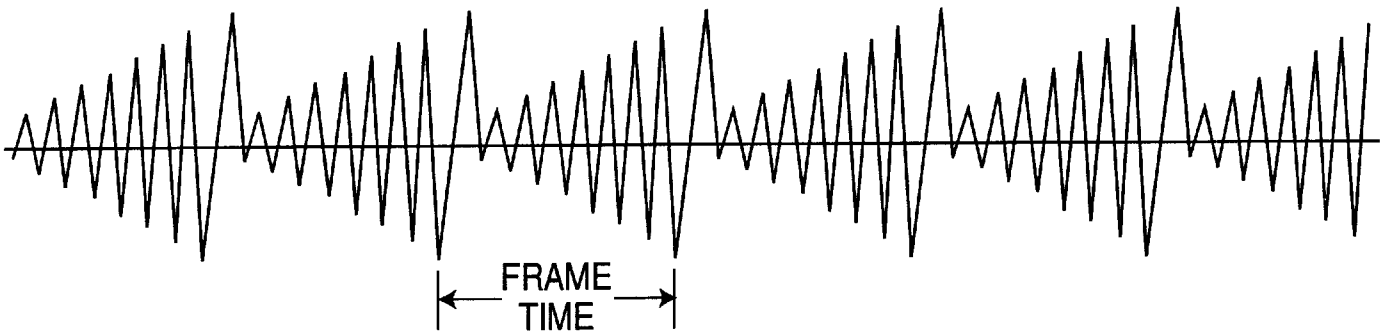

In the embodiment just described the ramp signal is modified to vary the number of inhibited pulses and, thereby, to increase the number of possible gray shades. The AC high voltage is kept at a constant level and is on continuously. In another embodiment of this invention, the AC high voltage is varied to further increase the number of greyscale levels and to introduce Gamma correction to the pixel illumination. This is illustrated in FIG. 5*a*, which shows the standard uniform high voltage AC signal (voltage is constant within a peak-to-peak range of 80–200 volts), and FIG. 5*b* which shows the linearly ramped high voltage AC signal (voltage ramped linearly from a minimum of 50 volts peak-to-peak to a maximum of 150 volts peak to peak).

When the AC voltage is ramped linearly by AC generator 120 and the illumination ramp is also ramped linearly by ramp generator 204 then the combined effect has a square law dependence of brightness on the analog data. This is very close to the optimum dependence, which is a 2.2 power law dependence. Furthermore, since the brightness of the lower order bits is reduced, a linear increase in the AC voltage adds several bits to the greyscale range. Combining all of the various techniques described above, a minimum of 8 bits of greyscale with a nominal gray scale range of over 2500:1 may be achieved.

While the nominal brightness of the array is about 75 fL, array brightness may be increased or decreased by changing either the AC voltage or the AC frequency. To achieve a maximum brightness of 300 fL either the AC voltage or AC frequency may be increased; to reduce the brightness to about 0.5 fL, both the voltage and frequency is may be reduced. It will be appreciated that all gray shades are not visible when the illumination is reduced below 10 fL.

Figure 6:
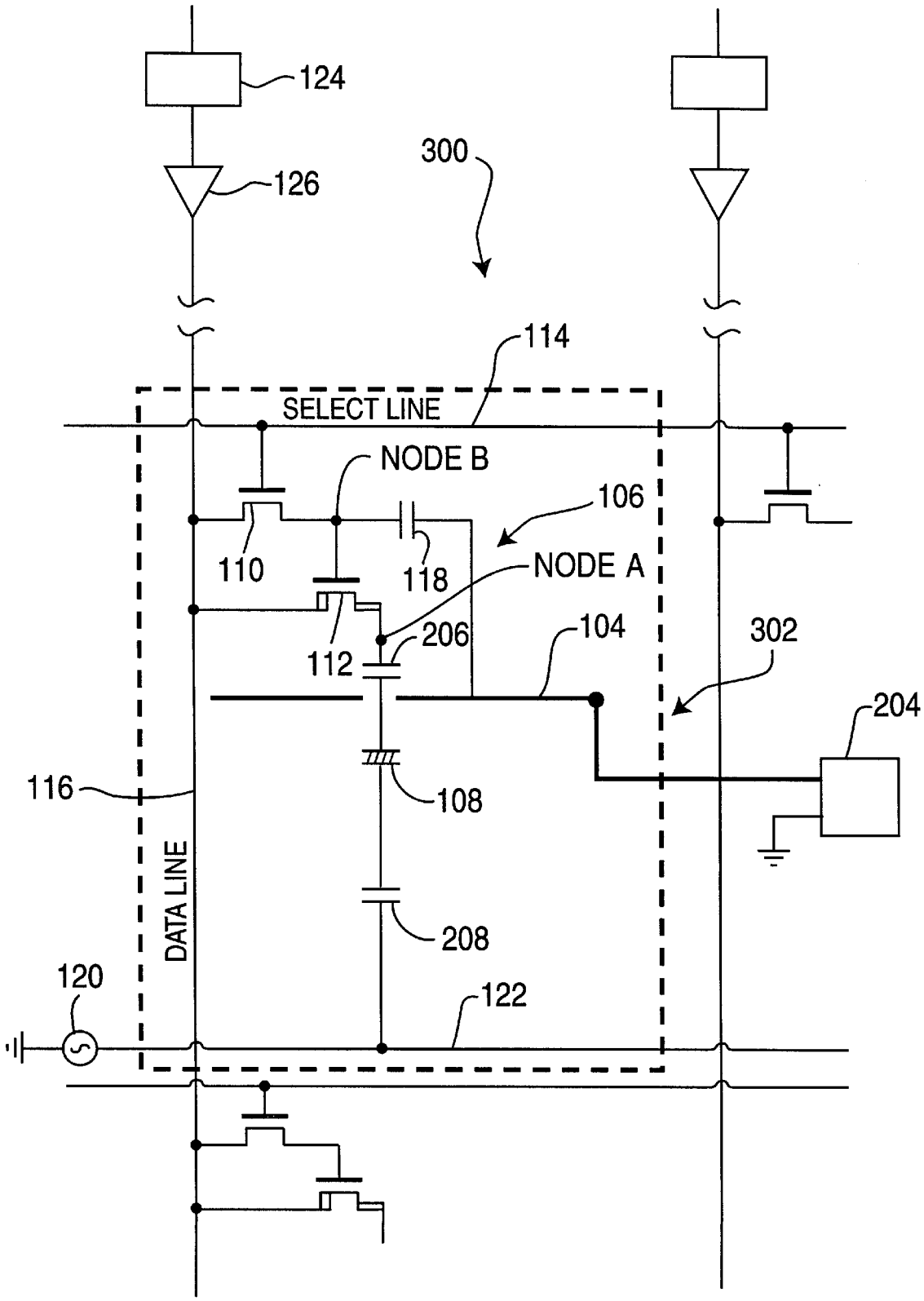
FIG. 6 depicts a schematic diagram of an AMEL display pixel driven by an analog driver in accordance with another embodiment of the present invention.

FIG. 6 shows yet another embodiment of the invention. FIG. 6 depicts pixel 302, which is one pixel in an arrangement of rows and columns of pixels in AMEL display 300. Similar to the pixel disclosed by FIG. 2, pixel 302 contains an electric field shield 104 between the switching circuit, comprising transistors 110 and 112. Instead of connecting the ramp generator 204 to the source of transistor 112 as disclosed by FIG. 2, the ramp generator 204 is connected to shield 104 as shown in FIG. 6. This pixel structure has the advantage of reducing the number of connections to the pixel compared to the structure shown in FIG. 2, and also has the advantage of eliminating unwanted coupling of the ramp signal from the source of transistor 112 to the floating node at the gate of transistor 112.

The pixel structure, however, doubles the total drain-to-gate voltage of transistor 110. This is due to the voltage on the gate of transistor 110 having to equal the highest data voltage (for instance +5.0V) while the drain of transistor 110 may be as low as the most negative ramp voltage (for instance −5.0V). In the pixel of FIG. 2 the maximum gate-to-drain voltage across transistor 110 is only equal to the maximum data voltage (in this example +5.0V).

Writing to the pixel starts with select line 114 set to logic-low and PMOS transistor 110 is turned on. A datum from the data line 116 is loaded into the storage node B through transistor 110. The voltage applied to the select line is then increased turning off transistor 110, thus completing the pixel loading sequence. To illuminate the pixel the ramp signal is connected to the shield and coupled to the floating node B through capacitor 118. The voltage on node B is the sum of the data voltage plus the ramp voltage. The pixel continues to be illuminated as long as the voltage on node B is above the threshold voltage of transistor 112, that is, as long as transistor 112 is conducting.

Since data may be loaded into the pixel at any point in the frame time and hence, at any point along the ramp signal on shield 104, it is necessary to modify the data being loaded into the pixel by summing it with the ramp voltage before loading the data into the pixel. For example, if it is desired to have the pixel "on" for half a frame period, a data voltage of 2.5 V is sent from the system to the display while the ramp may be changing, for example, between 0.0V and 31 5.0V. If the data level is received at the beginning of the ramp sequence, then 0.0V is added to the 2.5 V data voltage and the data voltage is loaded into the pixel. The pixel continues to illuminate while the ramp is between 0.0V and −2.5 V but does not illuminate while the ramp voltage is between −2.5V and −5.0V (assuming that the threshold voltage of transistor 112 is 0.0V).

If the +2.5V data level is received in the middle of the ramp sequence then −2.5V is added to the data voltage making it equal to zero and, hence, the pixel does not illuminate for the remainder of the frame time while the ramp is changing between −2.5V and −5.0V, but does illuminate during the second frame when the ramp is between 0.0V and −2.5V.

If the 2.5V data level is received at the end of the frame time when the ramp is at −5.0V, then −5.0V is added to the data voltage making it equal to −2.5V. When the ramp is switched to 0.0V at the beginning of the next frame the voltage on node B then increases to +2.5V and the pixel illuminates until the ramp voltage drops to −2.5V and the voltage on node B drops to zero turning off transistor 112 and stopping the illumination. Hence, the pixel illuminates for half the frame period under all data load conditions.

Figure 7:
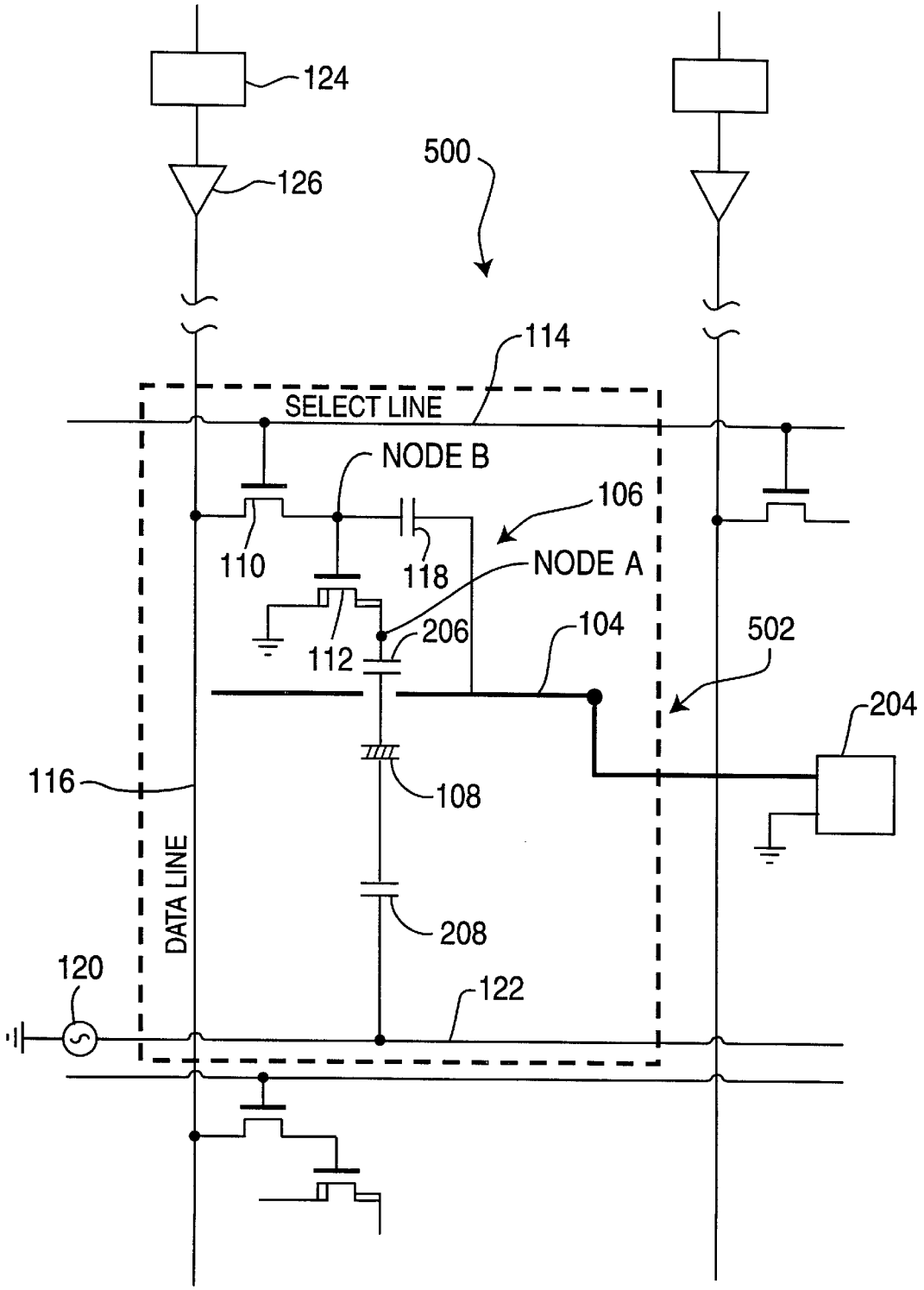
FIG. 7 depicts a schematic diagram of an AMEL display pixel driven by an analog driver in accordance with yet another embodiment of the present invention.

FIG. 7 shows still another embodiment of the present invention. FIG. 7 depicts pixel 502, which is one pixel in an arrangement of rows and columns of pixels in AMEL display 500. Similar to the pixel disclosed by FIG. 6, pixel 502, however, has the source of transistor 112 connected to ground. This pixel structure has similar advantages, namely the advantage of reducing the number of connections to the pixel compared to the structure shown in FIG. 2, and also has the advantage of eliminating unwanted coupling of the ramp signal from the source of transistor 112 to the floating is node at the gate of transistor 112.

Although illustrated and described herein with reference to certain specific embodiments, the present invention is nevertheless not intended to be limited to the details shown. Rather, various modifications may be made in the details within the scope and range of equivalents of the claims and without departing from the invention. It will be understood, for example, that the present invention is not limited to the specific embodiments of transistors described for FIGS. 2 and 6. Rather, the invention may be extended to any combination of transistors, such as two PFETs, two NFETs, or one NFET and one PFET. Furthermore, the invention may be extended to any combination of frequency values and voltage values for the signals described. Moreover, the shape of the ramps for either the data line signals, the shield signals or the AC high voltage ramp signals may also be changed. The invention may also be extended to other kinds of emissive displays, not necessarily that of an EL display.

Another variation to the specific embodiment, described may have an array of pixels loaded with data at any time in the frame period and illuminated at any time in the frame period without the exemplary structure shown in FIGS. 2 and 6. Rather, the invention may be extended to other structures permitting asynchronous loading of data and illumination of the loaded pixel.

What is claimed:

1. An emissive display having an array of pixels, each pixel comprising a first transistor having its gate connected to a select line, its source connected to a data line, and its drain connected to the gate of a second transistor, for applying an illumination voltage level to the gate of the second transistor, the second transistor having its source coupled to receive a ramped voltage level, and its drain connected to a first electrode of an emissive cell, and said emissive cell having a second electrode connected to an alternating current high voltage power source, wherein the emissive cell emits light when the ramp voltage level is lower than the illumination voltage level on the gate of the second transistor.

2. The emissive display of claim 1 further comprising a capacitor connected between the gate of the second transistor and a ground reference potential.

3. The emissive display of claim 1 wherein the ramp voltage level is increased linearly during a frame duration, and the alternating current high voltage power source is continuously active during the same frame duration.

4. The emissive display of claim 3 wherein the ramp voltage level is increased linearly from 0 volts to 7 volts during the frame duration.

5. The emissive display of claim 1 wherein the high voltage power source has a predetermined frequency, said predetermined frequency being selected from a range of frequencies wherein a higher frequency corresponds to an increased brightness while the pixel is emitting light.

6. An emissive display having an array of pixels, each pixel comprising a first transistor having its gate connected to a select line, its source connected to a data line, and its drain connected to a gate of a second transistor, the second transistor having its source connected to the data line, and its drain connected to a first electrode of an emissive cell, said emissive cell having a second electrode connected to an alternating current high voltage power source, and a capacitor having one terminal connected to the gate of the second transistor and another terminal which is coupled to receive a ramped voltage level, wherein the emissive cell emits light when the ramped voltage level added to a voltage level of the data line is greater than a threshold voltage level of the second transistor.

7. An emissive display having an array of pixels, each pixel comprising a first transistor having its gate connected to a select line, its source connected to a data line, and its drain connected to a gate of a second transistor, for applying an illumination voltage level to the gate of the second transistor, the second transistor having its source connected to a ground reference potential, and its drain connected to a first electrode of an emissive cell, said emissive cell having a second electrode connected to an alternating current high voltage power source, and a capacitor having one terminal connected to the gate of the second transistor and another terminal which is coupled to receive a ramped voltage level, wherein the emissive cell emits light when the ramped voltage level added to a voltage level of the data line is greater than a threshold voltage level of the second transistor.

8. In an emissive display having an array of pixels, each pixel including a circuit for controlling application of energy to an emissive cell associated with each pixel, a method for providing gray scale illumination during a frame duration comprising the steps of:

a) applying a data signal voltage level to the circuit along a data line and applying a select signal to the circuit along a select line;

b) storing the data signal within the circuit;

c) applying an alternating current high voltage to the emissive cell during the entire frame duration, a peak-to-peak value of the high voltage changing from a minimum peak-to-peak value to a maximum peak-to-peak value during the entire frame duration; and d) applying a ramp signal to the circuit along a further line, the ramp signal changing gradually from a first predetermined voltage level to a second predetermined voltage level over substantially the entire frame duration;

wherein the emissive cell is illuminated during a portion of the frame duration in which the ramp signal voltage level is lower than the data signal voltage level.

9. The method of claim 8 wherein step (d) further includes the step of linearly ramping the ramp signal from a low reference level to a high reference level during the entire frame duration.

10. In an emissive display having an array of pixels, each pixel including a circuit for controlling application of energy to an emissive cell associated with each pixel, a method for providing gray scale illumination during a frame duration comprising the steps of:

a) applying a data signal voltage level to the circuit along a data line and applying a select signal to the circuit along a select line;

b) storing the data signal within the circuit;

c) applying an alternating current high voltage to the emissive cell during the entire frame duration;

d) applying a ramp signal to the circuit along a further line, the ramp signal linearly ramping from a low reference level to a high reference level during a first interval of the frame duration; and e) inhibiting the emissive cell from illuminating during a second interval of the frame duration by setting the voltage level of the ramp signal to the high reference level during the second interval;

wherein the emissive cell is illuminated during a portion of the frame duration in which the ramp signal voltage level is lower than the data signal voltage level.

11. In an emissive display having an array of pixels, each pixel including a circuit for controlling application of energy to an emissive cell associated with each pixel, a method for providing gray scale illumination during a frame duration comprising the steps of:

a) applying a data signal voltage level to the circuit along a data line and applying a select signal to the circuit along a select line;

b) storing the data signal within the circuit;

c) applying an alternating current high voltage to the emissive cell during the entire frame duration;

d) applying a ramp signal to the circuit along a further line, the ramp signal linearly ramping from a low reference level to a high reference level during an entire first frame duration; and e) modifying the ramping voltage during a second frame duration by (i) linearly ramping the voltage level from a low reference level to a high reference level during a first interval of the second frame duration, (ii) inhibiting the emissive cell from illuminating during a second interval of the frame duration by setting the voltage level of the ramp signal to the high reference level during the second interval, and (iii) alternating the first frame duration and the second frame duration;

wherein the emissive cell is illuminated during a portion of the frame duration in which the ramp signal voltage level is lower than the data signal voltage level.

12. A method for providing a gray scale illumination for a display having an array of pixels comprising the steps of:

a) illuminating a pixel during a succession of frame intervals, b) ramping a voltage level applied to the pixel from a first predetermined voltage level to a second predetermined voltage level over substantially an entire frame time during each of the frame intervals, the ramp signal providing a voltage level that stops the illumination in each frame interval, wherein a first ramp signal is applied during a first frame interval and a second ramp signal is applied during a second frame interval, c) superimposing a first inhibit pulse during a first sub-interval of the first frame interval on the first ramp signal to stop the illumination during the first sub-interval, the illumination being responsive to the first ramp signal during the remainder of the first frame interval, d) superimposing a second inhibit pulse during a second sub-interval of the second frame interval on the second ramp signal to stop the illumination during the second sub-interval, the illumination being responsive to the second ramp signal during the remainder of the second frame interval, and e) sequentially repeating steps (c) and (d) during the succession of frame intervals.

13. A method for providing a gray scale illumination for a display having an array of pixels comprising the steps of:

a) illuminating a pixel during a succession of frame intervals, b) ramping a voltage level applied to the pixel from a first predetermined voltage level to a second predetermined voltage level over substantially an entire frame interval during each of the frame intervals, the ramp signal providing a voltage level that stops the illumination in each frame interval, wherein a first ramp signal is applied during a first frame interval and a second ramp signal is applied during a second frame interval, c) superimposing a first inhibit pulse during a first sub-interval of the first frame interval on the first ramp signal to stop the illumination during the first sub-interval, the illumination being responsive to the first ramp signal during the remainder of the first frame interval, d) repeating step (c) during the succession of frame intervals.

14. A method for providing a gray scale illumination for a display having an array of pixels comprising the steps of:

a) illuminating a pixel during a succession of frame intervals, b) ramping a voltage level applied to the pixel from a first predetermined voltage level to a second predetermined voltage level over substantially an entire frame interval during each of the frame intervals, the ramp signal providing a voltage level that stops the illumination in each frame interval, wherein a first ramp signal is applied during a first frame interval and a second ramp signal is applied during a second frame interval, c) superimposing a first inhibit pulse during a first sub-interval of the first frame interval on the first ramp signal to stop the illumination during the first sub-interval, d) superimposing a second inhibit pulse during a second sub-interval of the first frame interval on the first ramp signal to stop the illumination during the second sub-interval, wherein the illumination is responsive to the first ramp signal during the remainder of the first frame interval, and e) repeating steps (c) and (d) during the succession of frame intervals.

15. A method for providing a gray scale illumination for a display having an array of pixels comprising the steps of:

a) illuminating a first pixel and a second pixel during a succession of frame intervals, b) ramping a first ramp signal and a second ramp signal applied to the first and second pixels respectively from a respective initial voltage level to a respective final voltage level, each of the ramp signals being ramped over substantially an entire frame time, the ramp signal providing a voltage level that stops the illumination of each pixel, wherein a first ramp signal is applied during a first frame interval and a second ramp signal is applied during a second frame interval, c) superimposing a first inhibit pulse during a first sub-interval of the first frame interval on the first ramp signal to stop the illumination during the first sub-interval, the illumination being responsive to the first ramp signal during the remainder of the first frame interval, d) superimposing a second inhibit pulse during a second sub-interval of the second frame interval on the second ramp signal to stop the illumination during the second sub-interval, the illumination being responsive to the second ramp signal during the remainder of the second frame interval, and e) repeating steps (c) and (d) during the succession of frame intervals.

16. A method for providing a gray scale illumination for a display having an array of pixels comprising the steps of:

a) illuminating a first pixel and a second pixel during a succession of frame intervals, b) ramping a first ramp signal and a second ramp signal applied to the first and second pixels respectively from a respective initial voltage level to a respective final voltage level, each of the ramp signals being ramped over substantially an entire frame time, the ramp signal providing a voltage level that stops the illumination of each pixel, wherein a first ramp signal is applied during a first frame interval and a second ramp signal is applied during a second frame interval, c) superimposing a first inhibit pulse during a first sub-interval of the first frame interval on the first ramp signal to stop the illumination during the first sub-interval, d) superimposing a second inhibit pulse during a second sub-interval of the first frame interval on the first ramp signal to stop the illumination during the second sub-interval, wherein the illumination is responsive to the first ramp signal during the remainder of the first frame interval, and e) repeating steps (c) and (d) during the succession of frame intervals.

* * * * *